United States Patent [19]

Schaer

[11] 4,324,623

[45] Apr. 13, 1982

[54] METHOD AND APPARATUS FOR REPLENISHING AN ELECTROPLATING BATH WITH METAL TO BE DEPOSITED

[75] Inventor: Glenn R. Schaer, Columbus, Ohio

[73] Assignee: Koito Seisakusho Co. Ltd., Tokyo, Japan

[21] Appl. No.: 223,207

[22] Filed: Jan. 7, 1981

[30] Foreign Application Priority Data

Jan. 12, 1980 [JP] Japan ..... 55/2243

[51] Int. Cl.[3] ..... C25D 5/00; C25D 21/02; C25D 21/06; C25D 21/18

[52] U.S. Cl. ..... 204/15; 204/235; 204/236

[58] Field of Search ..... 204/15, 235, 236, 234, 204/28

[56] References Cited

U.S. PATENT DOCUMENTS

| | | | |
|---|---|---|---|
| 1,527,305 | 2/1925 | Hutchins | 204/235 |
| 1,601,693 | 9/1926 | Merritt | 204/236 |
| 2,072,811 | 3/1937 | Ellsworth | 204/236 |
| 2,449,422 | 9/1948 | Smith | 204/234 |
| 4,053,370 | 10/1977 | Yamashita | 204/15 |
| 4,119,516 | 10/1978 | Yamaguchi | 204/15 |

*Primary Examiner*—T. M. Tufariello
*Attorney, Agent, or Firm*—George B. Oujevolk

[57] ABSTRACT

For replenishing a plating bath with copper or other metal to be electrodeposited with the use of an insoluble anode, scrap metal such as copper wires is received in a makeup tank, into which are passed the gases generated within the plating tank with the progress of electroplating operation. The plating solution in the plating tank is also directed into the makeup tank and sprayed on the scrap copper wires, thereby dissolving same. The dissolved copper is then filtered, heated, and introduced into the plating tank.

11 Claims, 3 Drawing Figures

METHOD AND APPARATUS FOR REPLENISHING AN ELECTROPLATING BATH WITH METAL TO BE DEPOSITED

CROSS-REFERENCE TO RELATED APPLICATIONS

Applications entitled "Apparatus for Electroplating Strip Material without Current Leakage" and "Semiclosed Electrolyte Recovery System for Electroplating Apparatus", both assigned to the assignee of the present application, are filed substantially concurrently herewith.

BACKGROUND OF THE INVENTION

1. Field of the Invention

My invention pertains to the art of electroplating with the use of anodes of the nonconsumable type, commonly known as insoluble anodes, and in particular to a method of and apparatus for replenishing a plating solution with the metal to be deposited in such electroplating operation. The method and apparatus according to our invention have particular utility in conjunction with continuous electroplating or electroforming apparatus of the type disclosed in Yamashita et al. U.S. Pat. No. 4,053,370 dated Oct. 11, 1977, of the type described and claimed in Yamaguchi U.S. Pat. No. 4,119,516 dated Oct. 10, 1978, and of the type described and claimed in the above referenced application entitled "Apparatus for Electroplating Strip Material without Current Leakage".

2. Description of the Prior Art

The above cited U.S. Pat. No. 4,119,516, for example, proposes electroplating apparatus useful for the fabrication of metal foil, for use in the manufacture of printed electronic circuitry, or printed circuit patterns on a continuous strip of electrically conductive material such as stainless steel or nickel. The apparatus comprises a cathode under which the continuous strip is fed slidingly and thereby made cathodic, and two insoluble anodes underlying the cathode, with an interelectrode gap between each anode and the conductive strip traveling under the cathode.

An electroplating solution for use in the prior patented apparatus contains the metal to be deposited, notably copper. Made to flow turbulently through the interelectrode gaps, the solution speedily and uniformly deposits the metal on the downward-facing surface of the conductive strip advancing continuously over the successive anodes. The surface of the conductive strip must previously be masked with a plating resist for the fabrication of circuit patterns and can be blank for foil production.

With the progress of the electroplating or electroforming operation the bath becomes gradually depleted of its metal content. A periodic replenishment of the bath is therefore a necessity to keep the metal concentration therein within required limits. Toward this end the plating industry has had to purchase a soluble compound of the metal, for introducing its solution into the bath. In the case of an acid copper plating bath, for example, copper has been added in the form of a solution of purchased copper sulfate. This practice is objectionable for the following reasons:

1. The added copper sulfate solution inordinately increases the volume of the bath if the electroplating apparatus incorporates an electrolyte recovery system such as that proposed by the above noted application entitled "Semiclosed Electrolyte Recovery System for Electroplating Apparatus". The bath volume increases even more in the case where insoluble anodes are used.

2. With the use of insoluble anodes, sulfate ions increase, lessening the solubility of copper sulfate and causing its recrystallization and consequent settling down to the bottom of the plating tank.

3. The copper sulfate solution can introduce such cation contaminants as iron, nickel, zinc, and chromium, increasing the internal stress of the electrodeposited copper, decreasing its elongation ability and malleability, and impairing its hardness and other properties.

4. Copper sulfate is not so cheap as can be desired.

Ultimately, therefore, the plating solution must be discarded. Thus the conventional method of bath replenishment is not, or at least hardly, compatible with the electrolyte recovery system.

SUMMARY OF THE INVENTION

It is an object of my invention to provide an improved method of and apparatus for replenishing a plating bath with the metal to be deposited with the use of an insoluble anode or anodes, far more economically than has been feasible heretofore.

Another object of my invention is to provide such a method and apparatus which does not increase the volume of the plating solution in adding the metal thereto.

A further object of my invention is to provide such a method and apparatus which makes use of the gases emitted as a result of the electrolysis within a plating vessel, instead of allowing them to escape from the vessel and so to pollute the work environment.

A still further object of my invention is to provide such a method and apparatus which is compatible with an electrolyte recovery system of the type disclosed in the separate application mentioned previously.

In summary my invention proposes, for replenishing a plating bath with a metal to be deposited, the use of the metal in a solid state. Preferably, and particularly in the case of copper, our invention suggests the use of scrap wires because of their availability, cheapness, and ready solubility. For dissolving the scrap metal, the plating solution within a plating tank and the gases generated therein with the progress of plating operation are both passed into an enclosed space accommodating the scrap metal. In the case of an acid copper plating bath the scrap copper wires can be dissolved into a copper sulfate solution, which can then be introduced into the bath.

The copper sulfate solution should preferably be heated prior to its introduction into the bath. In a preferred embodiment, therefore, the copper sulfate solution is directed from the enclosed space into a heater tank in constant communication therewith. The heater tank serves the dual purpose of heating the copper sulfate solution and allowing sedimentation of solids that may be contained therein. The heater tank is also in constant communication with the plating tank, and the copper sulfate solution overflows from the former to the latter.

The above and other objects, features and advantages of my invention and the manner of attaining them will become more apparent, and the invention itself will best be understood, from the following description which is to be read in connection with the accompanying drawings.

DETAILED DESCRIPTION

General

The following detailed description of my invention pre-supposes the use of an acid copper electroplating bath and associated equipment for continuous fabrication of copper foil or printed circuit patterns, by way of one possible application of the invention. The bath is therefore to be replenished with copper by the method and means of our invention.

Figure 1:
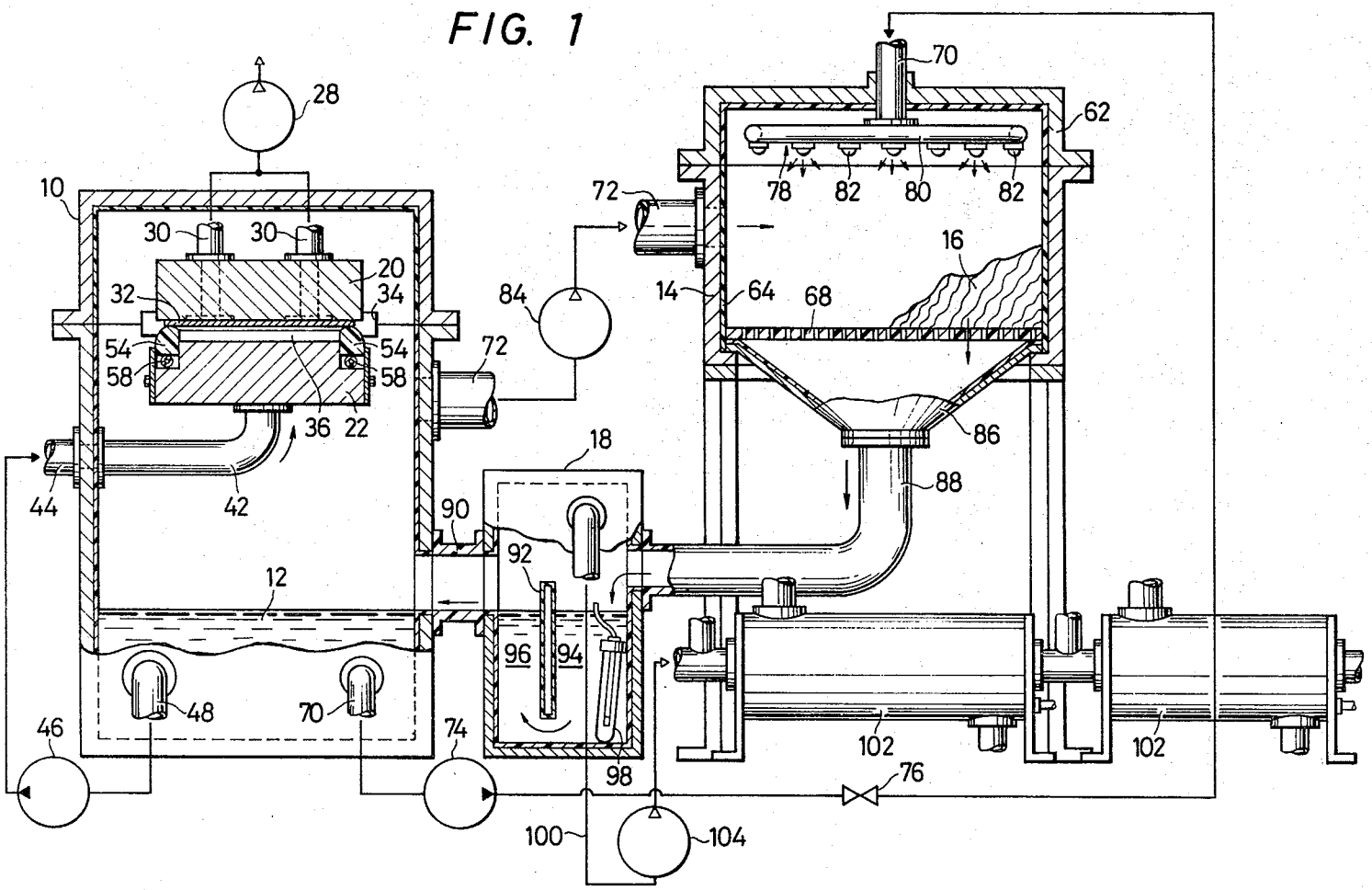
FIG. 1 is a vertical sectional view, partly in elevation, of the apparatus embodying my invention, the apparatus being here shown adapted for adding copper to an acid copper electroplating bath used for the production of copper foil or circuit patterns on a continuously advancing strip of electrically conductive material.

With reference first to FIG. 1 the apparatus illustrated therein can be broadly divided into electroplating means and bath-replenishing means. The electroplating means include a tank or vessel 10 containing an acid copper electroplating solution 12. The bath-replenishing means comprise a makeup tank 14 for producing a copper sulfate solution by dissolving scrap copper 16, and a heater tank 18 for heating the copper sulfate solution to a required temperature range before its introduction into the plating tank 10.

The configurations of the plating tank 10, the makeup tank 14 and the heater tank 18 will hereinafter be described under the respective headings. The operational description of the overall apparatus will follow the descriptions of the three tanks and will serve also as a disclosure of the inventive method.

Plating Tank

The illustrated electroplating equipment including the plating tank 10 is described and claimed in the aforementioned separate application entitled "Apparatus For Electroplating Strip Material without Current Leakage". A brief description of the electroplating equipment will therefore suffice, further details being disclosed in that application.

Figure 2:
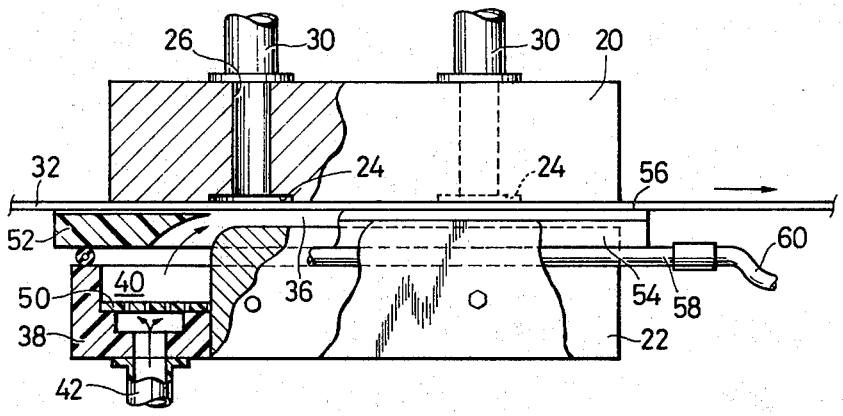
FIG. 2 is an enlarged, left hand side elevational view, partly in section and with parts shown broken away for clarity, of the cathode, insoluble anode and other means mounted within the plating tank shown in FIG. 1.

As shown in both FIGS. 1 and 2, the plating tank 10 contains a cathode 20 and, thereunder with some spacing, an insoluble anode 22. The cathode 20 has formed in its bottom surface several depressions 24 communicating with respective passageways 26 extending vertically through the cathode. These passageways 26 communicate with a vacuum pump 28 via vacuum conduits 30.

A strip 32 of electrically conductive material, on which copper foil or circuit patterns are to be electrodeposited, passes horizontally under the cathode 20 in the direction of the arrow in FIG. 2 or toward the viewer in FIG. 1. At 34 in FIG. 1 is shown an entrance opening into the plating tank 10 for the conductive strip 32. During such travel of the conductive strip 32 through the plating tank 10, the vacuum pump 28 creates a partial vacuum in the cathode depressions 24 thereby exerting suction on the conductive strip. Thus the conductive strip 32 advances in sliding contact with the bottom surface of the cathode 20 and in sufficient electrical contact therewith to become cathodic.

A suitable interelectrode gap 36 exists between insoluble anode 22 and conductive strip 32 traveling under the cathode 20. The plating tank 10 receives the acid copper plating solution 12 to a level considerably lower than the interelectrode gap 36.

Mounted next to one end (upstream with respect to the predetermined traveling direction of the conductive strip 32) of the insoluble anode 22 is a solution inlet block 38 defining a solution inlet 40. The plating solution 12 is to be fed from this inlet 40 into the interelectrode gap 36 so as to flow turbulently therethrough along the conductive strip 32. The solution inlet 40 communicates by way of conduits 42 and 44 with a solution feed pump 46 located external to the plating tank 10. The solution feed pump 46 has an inlet conduit 48 communicating with the interior of the plating tank 10 at a point below the level of the plating solution 12 contained therein.

A diffuser plate 50 is fixedly mounted in the solution inlet 40. Perforated to permit the plating solution to pass therethrough, the diffuser plate 50 functions to make constant in the transverse direction of the conductive strip 32 the degree of turbulence of the plating solution flowing through the interelectrode gap 36.

Over the solution inlet block 38 there is mounted a shield block 52 for shielding the conductive strip 32 traveling thereover from premature copper deposition due to current leakage. The shield block 52 is molded integral with a pair of parallel spaced sealing bars 54 disposed on opposite sides of the interelectrode gap 36, with the shield block bridging the sealing bars at their upstream ends. The pair of sealing bars 54 have rounded top edges 56 for sliding but practically fluid-tight contact with the opposite side end portions of the downward-facing surface of the conductive strip 32.

The entire U-shaped unit comprising the shield block 52 and sealing bars 54 is mounted on the insoluble anode 22 and solution inlet block 38 via a lifter tube 58 of elastic material. The lifter tube 58 can be placed in and out of communication with a compressor (not shown) via an air conduit 60. Upon delivery of compressed air into the lifter tube 58, same increases in diameter thereby lifting the U-shaped unit to such an extent that the pair of sealing bars 54 make sliding but fluid-tight contact with the conductive strip 32. The sealing bars 54 thus bound and seal the opposite sides of the interelectrode gap 36, constraining the flow of the plating solution only in the longitudinal direction of the conductive strip 32.

Makeup Tank

Like the plating tank 10 the makeup tank 14, including a removable top cover 62, is made of steel and has linings 64 of acid-resisting synthetic material such as polyvinyl chloride (PVC). The makeup tank 14 provides an enclosed space for accommodating a supply of scrap copper 16 to be dissolved and added to the plating solution 12 within the plating tank 10.

For efficient dissolution of the scrap copper 16 its surface area should be as large as possible in comparison with its weight. Two possible forms of the scrap copper 16 meeting this requirement are wires and thin sheets or foils. Wires are preferred, especially those not more than three millimeters in diameter, partly because of their ready availability. Such scrap copper wires 16 rest upon a filter 68 forming the bottom of the makeup tank 14. The filter 68 has pores such that it admits the passage of the dissolved copper therethrough, arresting the smallest pieces of wire produced with the progress of its dissolution.

The dissolution of the scrap copper wires 16 requires the plating solution 12 and oxygen-enriched atmosphere, both obtainable from the plating tank 10. To this end the makeup tank 14 communicates with the plating tank 10 by way of conduit systems 70 and 72. The conduit system 70 has a pump 74 and an on-off valve 76. With this valve 76 opened, therefore, the plating solution 12 can be pumped from the plating tank 10 into the makeup tank 14.

The conduit system 70 communicates with a spray nozzle assembly 78 suitably mounted inside the top cover 62 of the makeup tank 14. The spray nozzle assembly 78 comprises piping 80, as of PVC, of suitable arrangement communicatively jointed to the conduit system 70, and a plurality or multiplicity of spray nozzle units 82 communicatively coupled to the piping 80. The spray nozzle units 82 are of such relative placement that the plating solution pumped up from the plating tank 10 can be sprayed over the complete scrap copper wires 16 on the filter 68.

The aforesaid conduit system 72 has a built-in blower 84 for drawing out of the plating tank 10 oxygen and other gases produced as a result of the electroplating operation. The blower 84 delivers such gases into the makeup tank 14. The conduit system 72 is connected to the plating tank 10 in the adjacency of the interelectrode gap 36 where copper electrodeposition takes place.

Under the filter 68 at the bottom of the makeup tank 14 there is mounted a funnel 86 for collecting and directing downwardly the filtered solution of the scrap copper wires 16. The lower extremity of this funnel 86 is located some distance above the level of the plating solution 12 within the plating tank 10.

Heater Tank

The heater tank 18 is in constant communication with the makeup tank 14 by way of an L-shaped conduit 88. This conduit is coupled to the funnel 86 on one hand and, on the other hand, to the heater tank 18 at a point above the level of the plating solution 12 within the plating tank 10. Thus the filtered solution of the scrap copper wires 16 flows by gravity from the makeup tank 14 to the heater tank 18. The heater tank 18 is also in constant communication with the plating tank 10 by way of an overflow conduit 90, permitting the scrap copper solution to overflow into the plating tank. The level of the solution within the heater tank 18 is therefore substantially equal to the plating solution level within the plating tank 10.

An upstanding partition 92 divides the interior of the heater tank 18 into an upstream chamber 94 on the side of the makeup tank 14 and a downstream chamber 96 on the side of the plating tank 10. The top end of the partition 92 rises above the level of the solution within the heater tank 18, and its bottom end is spaced from the bottom of the heater tank. The solution is therefore free to flow under the partition 92 from the upstream 94 to the downstream 96 chamber. Both heater tank 18 and partition 92 are of steel, complete with PVC linings.

Within the upstream chamber 94 of the heater tank 18 a heater is provided for heating the solution prior to its overflow into the plating tank 10. In this particular embodiment the heater is shown as a simple electric heater 98 with a rod-shaped quartz envelope. Alternatively the heater tank 18 may itself be constructed to include a built-in steam heater.

A conduit system 100 communicates the heater tank 18 with a dual mist extractor 102. The conduit system 100 has a blower 104 for drawing mist-laden gases out of the heater tank 18 and forcing them into the dual mist extractor 102. This mist extractor forms a part of the recovery system for the plating solution 12 which is described and claimed in the above referenced separate application entitled "Semiclosed Electrolyte Recovery System for Electroplating Apparatus".

Operation

For the continuous fabrication of copper foil or circuit patterns by the electroplating means shown in FIGS. 1 and 2, the conductive strip 32 is fed at constant speed in the arrow-marked direction through the plating tank 10, in sliding contact with the cathode 20. The downward-facing surface of the conductive strip 32 has previously been masked with a plating resist for the production of circuit patterns and is blank for foil manufacture.

The pump 46 delivers the plating solution 12 to the solution inlet 40 and thence to the interelectrode gap 36. Direct current is introduced through the insoluble anode 22 thereby causing copper deposition on the downward-facing surface of the conductive strip 32 traveling under the cathode 20. The turbulent flow of the plating solution 12 through the interelectrode gap 36 is effective to prevent any undue decrease in copper ion concentration in the adjacency of the conductive strip 32 and hence to speed the deposition of copper thereon.

With the progress of the electroplating or electroforming operation the plating solution 12 emits gases including oxygen and sulfuric acid gas. The gases are highly toxic and strongly irritant to tissues. If they were not passed into the makeup tank 14 in accordance with our invention, the gases would escape as through the strip entrance opening 34 of the plating tank 10 thereby polluting the plant atmosphere. The loss of the gases is also undesirable from an economic point of view because they serve useful purposes as well. My invention utilizes these gases for dissolving the scrap copper wires 16, by directing them into the makeup tank 14 through the conduit system 72.

The dissolving of the scrap copper wires 16 can be commenced as, with the on-off valve 76 opened, the plating solution 12 is pumped into the makeup tank 14 through the conduit system 70. Sprayed with the plating solution by the spray nozzle assembly 78 in the presence of the gases from the plating tank 10, the scrap copper wires 16 dissolve into the form of a copper sulfate solution in accordance with the formula:

$$Cu + H_2SO_4 + \tfrac{1}{2}O_2 \xrightarrow{\text{heating}} CuSO_4 + H_2O$$

The heat required for this reaction derives from the plating solution itself, which normally is maintained in a temperature range of 60° to 65° C. within the plating tank 10. The higher the temperature of the sprayed plating solution, and the larger the surface area of the scrap copper in relation to its weight, the faster will be the rate of copper dissolution.

Figure 3:
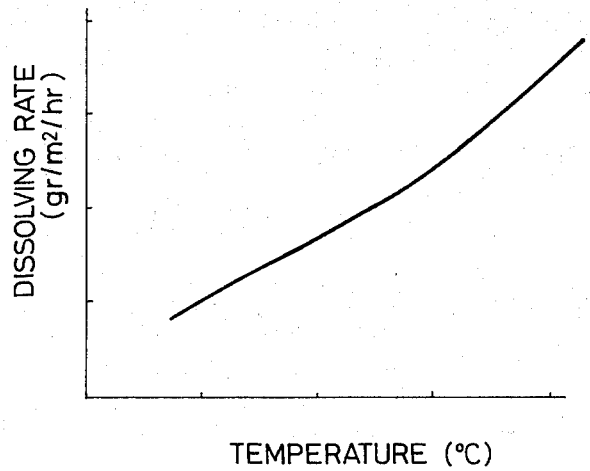
FIG. 3 is a graph plotting the curve of the dissolving rate of scrap copper wires against the temperature of the acid copper plating solution sprayed thereon, the scrap copper wires being dissolved in the apparatus of FIG. 1 to provide a copper sulfate solution to be fed into the plating tank.

FIG. 3 graphically demonstrates the dissolving rate of copper wires with a diameter of one millimeter versus the temperature of the plating solution sprayed thereon. The dissolving rate is given in grams per square meter of the total surface area of the copper wires per hour, and the temperature in degrees centigrade.

The copper sulfate solution produced in the makeup tank 14 is then filtered by the filter 68, collected by the funnel 86, and directed into the heater tank 18 by the conduit 88. Since the temperature of the solution flowing into the heater tank 18 will have dropped below the required range of 60° to 65° C., the heater 98 rapidly reheats the solution while it is flowing through the upstream chamber 94. The partition 92 within the heater tank 18 also serves to allow sedimentation of the minute pieces of scrap copper that have somehow passed the filter 68 of the makeup tank 14, before the solution passes on into the plating tank 10.

Thus heated and freed from solid particles, the copper sulfate solution flows under the partition 92 into the downstream chamber 96 and thence overflows into the plating tank 10 through the conduit 90. Copper being electrodeposited on the conductive strip 32 is thus added as required to the plating solution 12.

While I have herein shown and described our invention in what we have conceived to be the most practical and preferable embodiment, it is recognized that this embodiment is by way of example only, for our invention is applicable to electroplating or electroforming apparatus of other than the illustrated type. It is also understood that not only copper but also other metals and alloys, notably including nickel, cobalt, and nickel-cobalt alloy, can likewise be added to their plating baths in accordance with our invention. Since nickel and cobalt are less soluble than copper, however, the capacity of the makeup tank may be suitably increased, and there may be employed the scraps of such metals that have as large surface areas as possible per unit weight.

My invention is therefore not to be limited to the details disclosed herein but is to be accorded the full scope of the appended claims so as to embrace any and all equivalent forms.

I claim:

1. In a copper electroplating operation of the type wherein the copper is electrodeposited from an acid copper plating solution in a plating tank, a method of replenishing the plating solution with copper, which comprises:

(a) providing a solid-state supply of copper in an enclosed space;

(b) directing into the enclosed space the oxygen evolved within the plating tank with the progress of the electroplating operation;

(c) spraying the plating solution from the plating tank over the copper supply in the oxygen-enriched atmosphere for dissolving the copper supply; and, (d) returning the plating solution with its increased copper concentration into the plating tank.

2. The method of claim 1, further comprising the step of filtering the plating solution with the increased copper concentration prior to its return to the plating tank.

3. The method of claim 1, further comprising the step of heating the plating solution with the increased copper concentration prior to its return to the plating tank.

4. The method of claim 1, wherein the solid-state copper supply is in the form of copper scrap wire.

5. In a copper electroplating apparatus of the type wherein the copper is electrodeposited from an acid copper plating solution in a plating tank, the improvement comprising:

(a) a makeup tank for accommodating a solid-state supply of copper;

(b) means for directing into the makeup tank the oxygen evolved within the plating tank with the progress of the electroplating operation;

(c) means for spraying the plating solution from the plating tank over the copper supply in the makeup tank, the copper supply being dissolved when sprayed with the plating solution in an oxygen-enriched atmosphere; and (d) means for returning the plating solution with its increased copper concentration into the plating tank.

6. The apparatus of claim 5, further comprising means for filtering the plating solution with the increased copper concentration prior to its return to the plating tank.

7. The apparatus of claim 6, wherein the filtering means comprises a filter forming the bottom of the makeup tank.

8. The apparatus of claim 5, further comprising a heater tank interposed between the makeup tank and the plating tank for heating the plating solution with the increased copper concentration prior to its return to the plating tank.

9. The apparatus of claim 8, wherein the heater tank has a partition substantially dividing the interior thereof into an upstream chamber in communication with the makeup tank and a downstream chamber in communication with the plating tank, the upstream chamber and the downstream chamber being in open communication with each other under the partition, whereby the plating solution flows from the upstream to the downstream chamber in the heater tank.

10. The apparatus of claim 9, wherein the plating solution overflows from the downstream chamber of the heater tank into the plating tank.

11. The apparatus of claim 5, wherein the solid-state copper supply is in the form of scrap wire.

* * * * *